US007149460B2

(12) United States Patent
Hays

(10) Patent No.: US 7,149,460 B2
(45) Date of Patent: Dec. 12, 2006

(54) SYSTEMS AND METHODS FOR ELECTRON CHARGING PARTICLES

(75) Inventor: Dan A. Hays, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 153 days.

(21) Appl. No.: 11/081,034

(22) Filed: Mar. 16, 2005

(65) Prior Publication Data

US 2006/0210316 A1 Sep. 21, 2006

(51) Int. Cl.
*G03G 15/08* (2006.01)

(52) U.S. Cl. ..... 399/252; 399/289; 399/291; 399/293; 399/295

(58) Field of Classification Search ..... 399/252, 399/289, 290, 291, 292, 293, 294, 295
See application file for complete search history.

(56) References Cited

U.S. PATENT DOCUMENTS

| | | | | |
|---|---|---|---|---|
| 2,725,304 | A | 11/1955 | Landrigan et al. | |
| 5,656,409 | A | 8/1997 | Christy et al. | |
| 6,377,768 | B1 | 4/2002 | Hulin et al. | |
| 6,999,703 | B1 * | 2/2006 | Hays | 399/252 |
| 2004/0184840 | A1 * | 9/2004 | Hays | 399/252 |

FOREIGN PATENT DOCUMENTS

JP A-2002-268328 9/2002

JP A-2002-279885 9/2002

OTHER PUBLICATIONS

D. A. Hays et al.; "Electrostatic forces on ion-charged toner particles"; H. Morgan (Ed.), *Electrostatics 2003*; Inst. Phys. Conf. Ser. No. 178; pp. 77-82; 2004.

Haruo Iimura et al.; "Effects of an External Additive on Toner Adhesion"; *Journal of Imaging Science and Technology*; vol. 44, No. 5: pp. 457-461; Sep./Oct. 2000.

D.A. Hays; "Electric Field Detachment of Toner"; *Photographic Science and Engineering*; vol. 22, No. 4: pp. 232-235; Jul./Aug. 1978.

M. H. Lee et al.; "Adhesion of Toner to Photoconductor"; *Society of Photographic Scientists and Engineers*; vol. 11, No. 6: pp. 279-284; Dec. 1985.

Dan A. Hays; "Electric Field Detachment of Charged Particles"; *Particles on Surfaces 1: Detection, Adhesion, and Removal*; pp. 351-360; 1988.

(Continued)

*Primary Examiner*—Hoang Ngo
(74) *Attorney, Agent, or Firm*—Oliff & Berridge, PLC

(57) ABSTRACT

Electron charging of particles, as may be associated with electrographic and/or xerographic image forming devices, powder coat finishing devices and/or guns, or the like, is performed by subjecting a stream of particles to electron bombardment from at least one electrode overcoated with nanotubes, such as carbon nanotubes. An alternating electric field may be employed to reduce the possibility of charged particles being deposited on opposing electrodes in an electron charging zone defined by the electrodes. Particles of varying sizes, and of irregular shapes, may be uniformly charged while required input voltages to the system are reduced based on efficiencies gained through nanotube technology.

22 Claims, 2 Drawing Sheets

OTHER PUBLICATIONS

Orrin D. Christy; "Surface Adhesion Properties of Field Charged Toners in a High Speed Toner Applicator"; *Proceedings of IS&T's Eleventh International Congress on Advances in Non-Impact Printing Technologies*; pp. 176-179.

Yelena Shapiro et al.; Electrostatic Adhesion Calculations for Uniformly Charged Dielectric Spheres; Wilson Center for Research and Technology; Xerox Corporation.

James Q. Feng et al.; "Theory of Electric Field Detachment of Charged Toner Particles in Electrophotography"; Journal of Imaging Science and Technology; Vo. 44, No. 1: pp. 19-25; Jan./Feb. 2000.

Jennifer Ouellette; "Building the Nanofuture with Carbon Tubes"; *The Industrial Physicist*; pp. 18-21; Dec. 2002/Jan. 2003.

* cited by examiner

SYSTEMS AND METHODS FOR ELECTRON CHARGING PARTICLES

BACKGROUND

This disclosure is directed to systems and methods for charging particles with electron emission from carbon nanotubes and other nanotube variants, such as systems and methods for uniformly charging toner particles for use in document image forming, copying and printing devices, and/or pigment particles for use in electrostatic powder coat finishing applications.

Electrostatically charged particles are used as coloring agents in a number of different practical applications. These applications include electrophotographic and/or xerographic production and reproduction of documents throughout the electrophotographic industry, and electrostatic powder coat finishing processes employed in the painting and finishing industries. The advantages of using powder toners and/or coatings, when compared to liquid inks and other related coatings, include: ease of cleaning; reduction in the use of solvents; ability to collect overspray for potential reuse; and better control of uniformity of image or film thicknesses. In typical applications, electrostatically charged toner particles in image forming devices vary in size in a range of 3–15 μm in diameter, while electrostatically charged pigment particles used for powder coating have an average particle size in the range of approximately 30–40 μm in diameter. In either application, typically the particles are transported from a hopper to an apparatus in which an electrostatic charge is imparted to the particles prior to being further brought into contact with a charged or grounded surface upon which the particles are to be deposited and affixed.

Traditionally, triboelectric, or frictional electric, charging is typically the phenomenon and/or process which is used to impart the electrostatic charge to the particles. U.S. Patent Publication No. US 2004/0184840 A1 to Hays, published on Sep. 23, 2004 (hereinafter referred to as the "'840 Publication"), which is commonly assigned and the entire disclosure of which is incorporated herein by reference, describes the process of triboelectric charging and catalogs some of the advantages and disadvantages of triboelectric charging, specifically of toner particles.

The '840 Publication teaches that triboelectric charging is widely used in the eletrophotographic industry to charge toner particles. Triboelectric charging is performed by rubbing two dissimilar materials together, and in the course of such rubbing, a charge is transferred from one body to the other. A disadvantage is that the triboelectric charging phenomenon is very sensitive to surface conditions of the particle as well as temperature and humidity. Charge deposited on particles, particularly irregularly surfaced particles, can easily become non-uniform, resulting in localized areas of higher charge concentration on the particles. This increases the localized adhesion state of such particles to any surface, including the internal structural surfaces of the devices within which the electrostatically charged particles are manipulated. In electrophotographic and/or xerographic image forming devices, for example, this unwanted particle adhesion results in electrostatically charged particles such as, for example, toner particles, being "captured" along the pathways leading to an image on an image-carrying member, such as, for example, paper. This unwanted adhesion decreases the efficiency of the device because less than all of the available toner reaches the photoreceptor and subsequently the image-carrying medium. Reducing these adhesion forces results in delivering more toner to the image-carrying medium, thereby increasing the efficiency of transfer of the toner to the medium and the quality of the images produced. Additionally, there is a concomitant reduction in a requirement to clean adhered toner from the inside of the device and/or in a requirement to clean residual toner held by the photoreceptor.

For electrostatic powder coating applications, both tribocharging charging and ion charging guns are employed to charge the powder. For a tribocharging gun, an electrostatic charge is generated by friction between pigment particles and the gun barrel. When, for example, individual particles of epoxy powder used in powder coating move through a powder gun barrel, the particles rub against the inner surfaces and are electrostatically charged. For this reason, typical triboelectric powder guns used for powder coating have a long and tortuous barrel in order to increase the inside surface area, thereby increasing the triboelectric charging of the particles. A drawback of the tribocharging gun is that the types of powder materials that are compatible with the triboelectric charging process are limited.

For ion charging guns, a corona from a high voltage coronode wire is used to generate the electrostatic charge. Typical powder ion charging guns employed in powder coating applications require very high voltage power supplies of as much as 100 kV. Some of the ions are captured on the powder whereas the majority of ions are collected on the article to be coated. High ion charging of the coating is not desired since back ionization can occur that causes coating defects.

The '840 Publication proposes an ion-charging device for toner particles seeking to overcome disadvantages of conventional triboelectric charging and ion charging methods. The '840 Publication teaches a device for electrostatically charging toner particles by exposing the toner particles to unipolar gas ions emitted from opposing scorotrons that each consist of a coronode with pins of corona emitting points in combination with an electrically biased screen. The coronodes and screens are connected to power supplies through a network of high voltage diodes and resistors. A high voltage, e.g., in a range of 8 kV, AC power supply connected to the opposing scorotons through the diode and resistor network causes ions of a single polarity to be alternately generated by each scorotron during each half cycle in the region between the scorotrons where toner particles are entrained in an air stream. Thus, the toner particles accumulate charge of a single polarity as they flow through the zone between the scorotrons. The alternating electric field in the charging zone prevents deposition of toner on the coronodes and screens of the opposing scorotrons. The invention disclosed in the '840 Publication includes an apparatus for charging particles prior to being delivered to a development delivery device.

The '840 Publication explains that toner particle charging with ions has a number of advantages including insensitivity to toner material surface properties thereby making the proposed device and/or process adaptable to particles with irregular surfaces. The '840 Publication points out that the disclosed device more uniformly charges irregular or spherical-shaped toner particles with further advantages of a reduction in toner adhesion to surfaces. The toner charging device disclosed in the '840 Publication may be viewed as a separable component of the disclosed image forming devices and is, in fact, described as an "interface" between various methods for supplying toner to such a device and developing an electrostatic image with ion-charged toner. The '840 Publication describes that the disclosed charging devices and methods improve electrophotographic development, electrostatic transfer and the ability of the overall image-forming device to be cleaned.

SUMMARY

It would be advantageous to continue to increase the efficiency of an electrostatic charging process by developing devices which may provide uniform charging of particles while enabling reduced particle adhesion. Further, were efficiencies obtainable which would allow a reduction in input voltages from current levels of, for example, approximately 8 kV for charging toner particles in image forming device and up to approximately 100 kV to generate a corona in an ion powder coat spray gun, simplified and more compact devices may be made available that may provide electrostatic particle charging capabilities across a broad spectrum of applications.

Nanotube technologies provide the opportunity to achieve such efficiencies. Carbon nanotubes, for example, represent a new molecular form of carbon in which a single layer of atoms is rolled into a seamless tube that is on the order of, e.g., 1 to 10 nanometers in diameter and up to hundreds of micrometers in length. Multi-walled nanotubes were first discovered by NEC Labs in 1991. Two years later, single-walled nanotubes were discovered. Nanotubes exhibit extraordinary electrical, mechanical and thermal conductivity properties. The thermal conductivity, for example, is much higher than that of copper. Nanotubes can be fabricated by a number of methods including carbon arc discharge, pulsed laser vaporization, chemical vapor deposition (CVD) and high-pressure carbon monoxide vaporization. It should be appreciated that other material variants of carbon nanotubes can be used for charging device such as those disclosed herein. Examples of nanotube material variants include boron nitride, bismuth and metal chalcogenides.

In simplest terms, a carbon nanotube, on a microscopic scale, appears like a hexagonally shaped poultry wire mesh formed of hexagonal carbon rings. Associated with each ring, or with each junction in the mesh, there is an unbound electron. These unbound electrons are free to move about allowing the entire mesh to act like a good conductor. Therefore, each carbon nanotube exhibits relatively high electrical conductivity because the electrons are not bound, but rather are free to move throughout the mesh. When a voltage is applied to create a high voltage electric field at the tip, electrons can tunnel out of the tube end to become field-emitted electrons.

In ion-charging devices for electrophotography, corotron wires are typically approximately 70 μm in diameter, and voltages of approximately 7 kV are required. In the case of carbon nanotubes, because they are relatively so much smaller, the voltages required to obtain the high fields resulting in electron emission are considerably less, for example reduced in many applications by an order of magnitude (or a factor of 10). Such voltage reductions may not only result in simpler and potentially safer devices but may also aid in reducing and/or eliminating undesirable byproduct gaseous components produced by an ion gas discharge in ion-charging devices. Such byproducts include, but are not limited to, ozone and/or nitrogen oxide.

With the CVD fabrication method discussed above, when used with a substrate catalyst, the nanotubes tend to be single-walled nanotubes and orient perpendicular to the substrate. Such structure lends itself to potential application in any manner of electron field emission devices such as, for example, displays. Japanese Patent Publication Nos. 2002-268328 to Toshihiro et al. and 2002-279855 to Akishige describe carbon nanotube electron field emission devices for the direct charging of photoreceptors in electrophotographic devices. These direct charging devices are concerned with operational stability of carbon nanotube field emission currents when operating a carbon nanotube charging device under atmospheric conditions, thereby leading to proposals for systems and methods to mitigate these concerns.

It may be advantageous to improve an electrostatic charging device of the '840 Publication by replacing the scorotrons, and diode and resistor network, with nanotube-overcoated plates or electrodes. For example, carbon single-walled nanotube fields could be formed perpendicular to a substrate thereby creating electron-emissive plates. Voltage requirements for such an electrostatic charging device may be significantly reduced while advantages of being able to impart a substantially uniform electrostatic charge to irregularly-shaped particles while minimizing particle adhesion are maintained. Such a device may find advantageous application not only in electrophotographic or electrographic image reproduction devices but also in devices concerned with particles of various and larger particle size such as, for example, electrostatic powder coat finishing devices and spray guns.

Exemplary embodiments of disclosed systems and methods may provide electron charging of electrostatic particles, particularly toner particles used for development of electrophotographic images in electrophotographic and/or xerographic image forming devices, and/or pigment particles used to apply paint-like finishes in powder coat finishing devices and/or spray guns.

Exemplary embodiments of disclosed systems and methods may provide electron emissions by applying an alternating voltage, such as, for example, a square-wave alternating voltage, to opposing electrodes overcoated with nanotubes, such as, for example single-walled carbon nanotubes. Such electrodes may be formed as plates and arranged substantially parallel to, and opposing, one another to form an electron-charging zone between the plates. Electron emission occurs alternately from each nanotube-overcoated electrode during a half cycle of the applied alternating voltage.

Exemplary embodiments of disclosed systems and methods may employ carbon nanotubes as the basic elements of which each of a plurality of electrode plates are formed.

Exemplary embodiments of disclosed systems and methods may employ electron emissions to charge particles flowing between a pair of electron-emissive electrodes and/or electrode plates subjected to an alternating voltage in order to impart increasing levels of electrostatic charge to the particles while decreasing the potential for particle deposition within an electron-charging zone within a device.

Exemplary embodiments of disclosed systems and methods may employ reduced input voltages, compared to those required in conventional ion-charging devices, in order to impart the same electrostatic charge to the same-sized particle.

Exemplary embodiments of disclosed systems and methods may find utility in a broad array of applications for electrostatically charging particles to include, but not be limited to, electrophotographic and/or xerographic image forming devices, and/or electrostatic powder coat finish applying devices and/or spray guns.

Exemplary embodiments of systems and methods according to this disclosure may reduce and/or eliminate undesirable byproducts produced by an ion gas discharge in ion-charging devices. Such byproducts include, but are not limited to, ozone and/or nitrogen oxide.

These and other features and advantages of various disclosed embodiments are described in, or apparent from, the following detailed description of various exemplary embodiments of systems and methods according to this disclosure.

BRIEF DESCRIPTION OF THE DRAWINGS

Various exemplary embodiments of systems and methods according to this disclosure will be described, in detail, with reference to the accompanying figures, wherein.

DETAILED DESCRIPTION OF EMBODIMENTS

The following detailed description of various exemplary embodiments of systems and methods for electron charging of electrostatic particles may alternatively refer to specific applications wherein toner particles are charged to support the production of images in electrophotographic and/or xerographic image forming devices, or wherein pigment particles are charged to support finish applications using electrostatic powder coat finishing devices in the painting and/or finishing industries. These references are included in order to enhance clarity of this disclosure and to provide ease of description and depiction of a readily available set of applications into which exemplary systems and methods according to this disclosure may be incorporated. It should be appreciated, however, that the principles disclosed and described herein may apply to any system or device that performs electrostatic charging of particles.

Figure 1:
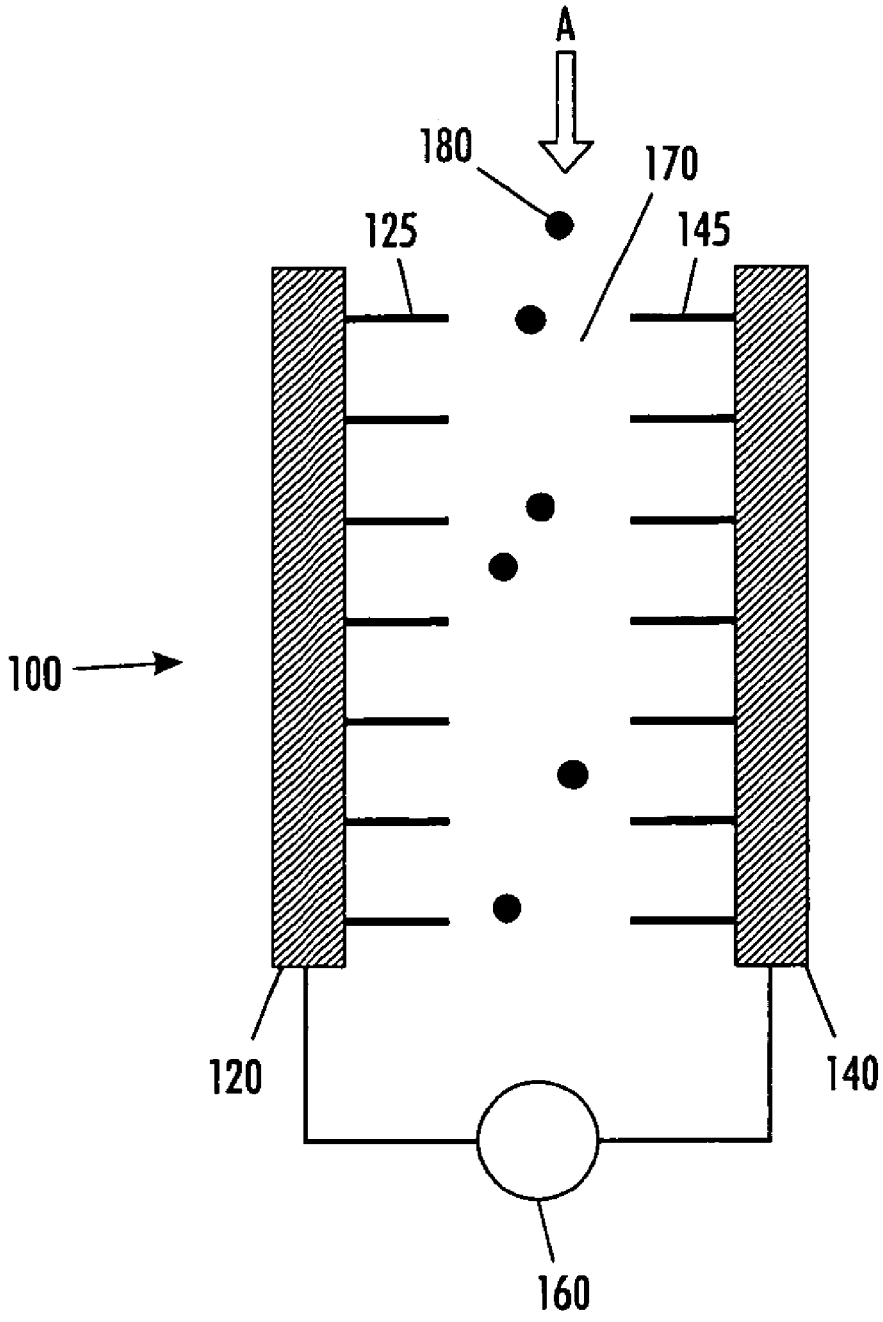
FIG. 1 illustrates a simple schematic diagram of an exemplary electron-charging device for charging electrostatic particles.

FIG. 1 illustrates a simple schematic diagram of an exemplary electron-charging device 100 for charging electrostatic particles. As shown in FIG. 1, an exemplary electron-charging device 100 includes at least one electrode 120, shown here as a plurality of electrodes 120,140 which are overcoated with, or otherwise formed of, nanotubes 125, 145. A nanotube forming process whereby the nanotubes 125,145 are formed so as to have the principle axis of the nanotubes perpendicular to the substrate which comprises the electrode 120,140 is preferred. It should be appreciated that other irregular structures of nanotubes can also be used for the purposes of charging devices such as those disclosed herein.

Exemplary nanotube-overcoated electrodes 120,140 are connected to at least one power supply 160 which supplies voltage, e.g., alternating voltage, to each of the electrodes 120,140. An objective of supplying voltage to the electrodes is to promote electron emission from at least one electrode into an electron-charging zone based on an electrical potential generated in the electron-charging zone between the at least one electrode and an electrical ground. In the embodiment shown in FIG. 1, two electrodes 120,140 are arranged substantially parallel to, and opposing, one another to form the electron-charging zone 170 between the electrodes 120, 140. In this configuration, alternating voltage, and preferably a square-wave alternating voltage, may be applied to each of the electrodes 120,140 in such a manner that the voltages applied respectively to the electrodes 120,140 are 180 degrees out of phase with one another.

Particles 180 that are intended to be electrostatically charged are conveyed, in some manner, such as, for example, in an-air or gas fluidized stream, into the electron-charging zone 170, being caused to move through that zone generally in a direction A. When the particles 180 enter the electron-charging zone 170, electron emission from the nanotubes 125,145 of electrodes 120,140 bombard the particles 180 alternately, from opposing sides of the electron-charging zone 170, with electrons emitted alternately from the opposing electrodes 120,140 in response to the alternating voltage being applied by the power supply 160. This mechanism of alternate bombardment of the particles 180 by electrons alternately emitted from opposing electrodes 120, 140 imparts electrostatic charge to the particles 180 and also tends to keep the particles 180 centered as they are axially conveyed through the electron-charging zone 170.

It should be appreciated that although the electron-charging zone 170 depicted in FIG. 1 comprises two nanotube-overcoated electrodes 120,140 to which a power 160 supplies alternating voltage, a single nanotube-overcoated electrode opposing an uncoated electrode, or any number of multiple electrodes, may be appropriately configured to form an electron-charging zone 170 for imparting electrons from a nanotube overcoating in response to an applied alternating voltage. Further, it should be appreciated that direct current voltages may be applied in embodiments as well provided the particle conveyance with a gas stream is sufficient for the particles to exit the charging zone 170.

Figure 2:
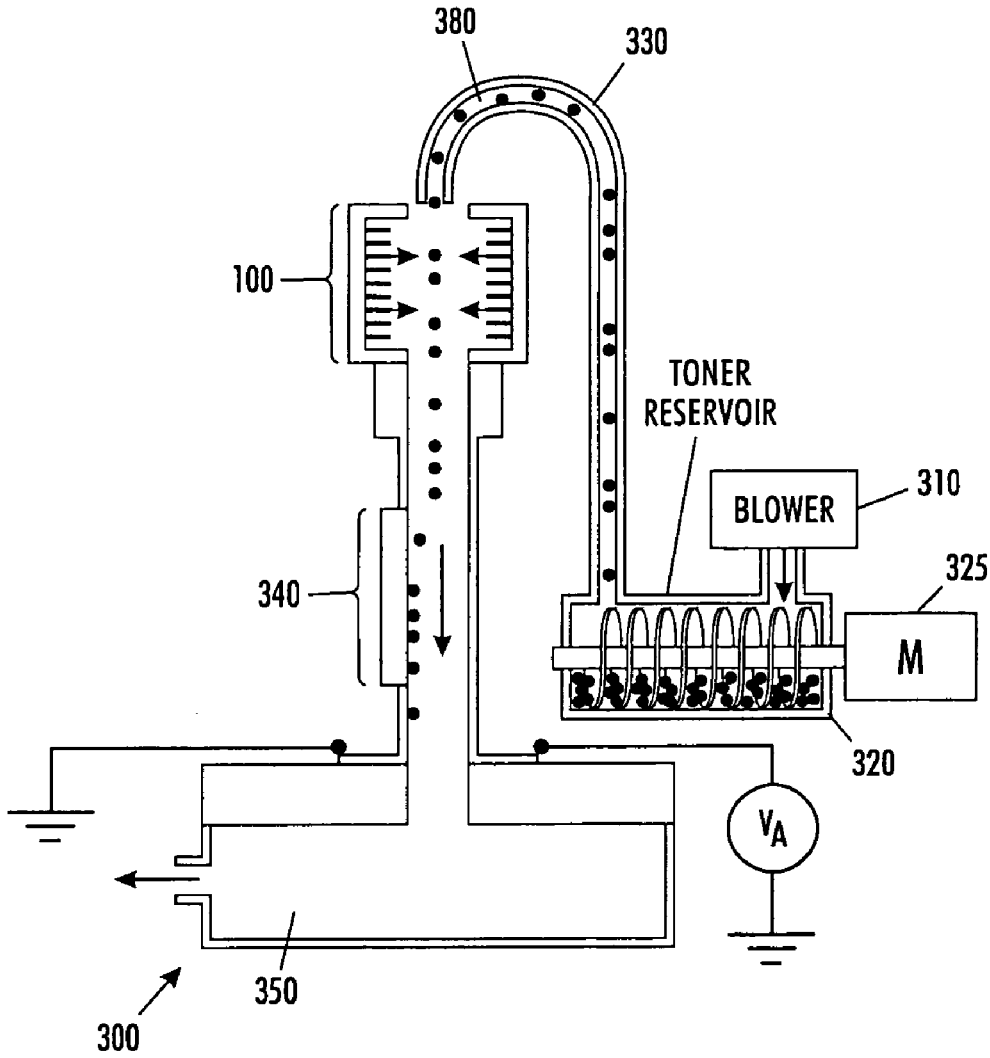
FIG. 2 illustrates an exemplary embodiment of a device for delivering, charging, and collecting particles, including an exemplary electron-charging device for charging particles according to the systems and methods of this disclosure.

FIG. 2 illustrates an exemplary embodiment of a device 300 for delivering, charging, and collecting particles including an exemplary electron-charging device 100 for electrostatically charging particles according to the systems and methods of this disclosure. As shown in FIG. 2, a blower 310, or other air forcing device, may be available to generate an air or gas supply in order to entrain particles 380 in an airborne stream. A dispenser 320 may be provided with an agitation device 325 (shown as an auger type agitator in this embodimenta) attached to, or housed in, the dispenser 320 in order to agitate or otherwise move the particles 380 toward an exit from the dispenser 320 in order that the particles may be more easily entrained in the airborne stream produced by the blower 310, or may be otherwise conveyed from the dispenser 320.

It should be appreciated that any configuration in which particles are removed from a dispenser 320 or reservoir and conveyed through an electron-charging zone 270, as shown in FIG. 2, is contemplated. Many and widely diverse variations in configuration exist based on the specific application to which the electrostatically charged particles are intended to be used. For example, the dispenser 320 may represent a toner bottle containing toner particles for use in forming images in an electrophotographic and/or xerographic image forming device. Alternatively, the dispenser 320 may represent a powder coat powder reservoir attached to a powder coat spray gun.

Particles entrained in an air stream are transported via a channel 330 to an exemplary electron-charging device 100.

It should be appreciated that the channel 330 for conveying particles entrained in an air stream, or otherwise, from a dispenser 320 to an electron-charging zone in an exemplary electron-charging device 100 may include any of a rigid pipe and/or standpipe, and/or a flexible or semi-flexible hose depending on the required configuration by which the particles should be conveyed to the electron-charging device 100.

The electron-charging device 100 may subject the particles 380 conveyed through the electron-charging device 100 to alternate electron emission from either side of an electron-charging zone. Once the particles 380 are substantially uniformly charged with electrons, the particles may be deposited on an exemplary collection device 340. Such a collection device 340, when present, may, for example, represent an electrostatically-charged photoreceptor, or an electrostatically-charged image receiving medium in an electrophotographic or xerographic image forming device. Alternatively, the collection device 340 may represent a reservoir from which pigment particles may be otherwise conveyed to any manner of powder coat delivery system. Additionally, uncollected particles may be supplied separately to some manner of collection chamber 350 which may include a vacuum plenum type device to further aid circulation of the particles 380 through the system and on to any manner of delivery device. Particles which do not adhere to the collection device 340 and/or are not otherwise conveyed to a delivery device, may be collected or otherwise filtered in the collection chamber 350 for potential recirculation and/or reuse.

It should be appreciated that once the particles 380, appropriately air entrained or otherwise conveyed through the electron-charging device 100, become electrostatically charged, conventional conveying devices for transporting the particles 380 for use may be employed. In the case of electrophotographic or xerographic reproduction, the particles may be transported by a conventional device or system of devices to a photoreceptor and/or an image receiving medium in order to be deposited on an image receiving medium for forming an image in the electrophotographic and/or xerographic image forming device. For powder coat finishing applications, the electrostatically charged particles may be picked up in a second stream of high pressure air to be dispensed via an electrostatic powder coat spray gun nozzle, or through a dispensing apparatus in a powder coat spray booth, resulting in dispersion of the electrostatically charged particles as a powder coat cloud to be deposited on a structure intended to be powder coat finished.

Incorporation of disclosed systems and methods for electron charging of particles in conventional electrostatically-charged particle applications are contemplated. Because the range of devices within which such an electron-charging device may be installed is widely varied, yet conventionally known, individual depictions and/or descriptions of the details of those devices are not required.

It should be appreciated that, while disclosed systems and methods have been described in conjunction with exemplary electrophotographic and/or xerographic image forming devices, or alternatively in conjunction with electrostatic powder coat finish applying devices and/or guns, systems and methods according to this disclosure are not limited to such applications. Exemplary embodiments of systems and methods according to this disclosure may be advantageously applied to virtually any device, machine or equipment wherein electrostatically charged particles may be advantageously charged by electron emissions from electrodes formed of or overcoated with nanotubes, particularly carbon nanotubes. Advantages of the use of disclosed exemplary systems and methods may include: reduced input voltages for electrode plates which define an electron-charging zone of a device; substantially uniform charge distribution to varying sizes of possibly irregularly shaped particles; reduced deposition of particles within the charging zone; and reduced particle adhesion to surfaces.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A system for imparting an electrostatic charge to particles, comprising:

at least one electron-emissive electrode overcoated with nanotubes, the at least one electrode forming a particle electron-charging zone; and a power source for supplying electric voltage to the at least one electrode to promote electron emission from the at least one electrode into the particle electron-charging zone based on an electric potential generated in the electron-charging zone between the at least one electrode and an electrical ground.

2. The system of claim 1 further comprising a particle movement device usable to generate an air fluidized flow of particles through the particle electron-charging zone in order that an airborne stream of particles are electrostatically charged through bombardment by electrons emitted from the at least one electrode when the electric voltage is applied.

3. The system of claim 1, wherein the nanotubes are at least one of multi-walled carbon nanotubes, single-walled carbon nanotubes, materially-variant multi-walled nanotubes or materially-variant single-walled nanotubes.

4. The system of claim 1, wherein the power source supplies at least a sinusoidal alternating voltage or a square-wave alternating voltage to the at least one electrode.

5. The system of claim 1, further comprising at least a second electron-emissive electrode overcoated with nanotubes arranged substantially parallel to, and opposing, the at least one electrode forming a particle electron-charging zone therebetween, wherein the power source supplies electric voltage alternately to the at least one electrode and the at least the second electrode.

6. The system of claim 5, wherein the power source supplies at least a sinusoidal alternating voltage or a square-wave alternating voltage alternately to the at least one electrode and the at least the second electrode.

7. The system of claim 1, wherein the particles are electrostatically charged toner particles usable in image forming devices.

8. An image forming device comprising the system of claim 1.

9. A xerographic image forming device comprising the system of claim 1.

10. The system of claim 1, wherein the particles are electrostatically charged pigment particles usable as electrostatic powder coat finishes.

11. An electrostatic powder coat delivery system comprising the system of claim 1.

12. An electrostatic powder coat spray gun comprising the system of claim 1.

13. A method for imparting an electrostatic charge to particles, comprising:

energizing at least one electron-emissive electrode overcoated with nanotubes with an electric voltage to produce electron emissions into a particle electron-charging zone;

entraining particles in an airborne stream; and subjecting the airborne stream of particles to electron bombardment in the particle electron-charging zone when an electric voltage is applied.

14. The method of claim 13, wherein the nanotubes are at least one of multi-walled carbon nanotubes or single-walled carbon nanotubes.

15. The method of claim 13, wherein the particle electron-charging zone is formed of at least two electrodes being arranged substantially parallel to, and opposite, one another in order to form the particle electron-charging zone therebetween, and the at least two electrodes are alternately energized with an electric voltage.

16. The method of claim 15, wherein the electric voltage is at least one of a sinusoidal alternating voltage or a square-wave alternating voltage alternately applied to the at least two electrodes.

17. The method of claim 13, wherein the particles are electrostatically charged toner particles usable in an image forming device.

18. The method of claim 17, further comprising delivering the charged toner particles to an electrographic image forming unit in the image forming device.

19. The method of claim 17, wherein the image forming device is a xerographic image forming device.

20. The method of claim 13, wherein the particles are electrostatically charged pigment particles usable as electrostatic powder coat finishes.

21. The method of claim 20, further comprising delivering the charged pigment particles to an electrostatic powder coat delivery system for depositing powder coating on an object to be finished.

22. The method of claim 21, wherein the electrostatic powder coat delivery system comprises an electrostatic powder coat spray gun.

* * * * *